United States Patent [19]

Deutsch

[11] 4,175,463

[45] Nov. 27, 1979

[54] RESONATOR FOR A MUSICAL TONE SYNTHESIZER

[75] Inventor: Ralph Deutsch, Sherman Oaks, Calif.

[73] Assignee: Kawai Musical Instrument Mfg. Co. Ltd., Hamamatsu, Japan

[21] Appl. No.: 857,436

[22] Filed: Dec. 5, 1977

[51] Int. Cl.[2] ..... G10H 5/10

[52] U.S. Cl. ..... 84/1.19; 84/1.24; 84/1.11; 84/DIG. 9; 332/31 R

[58] Field of Search ..... 84/1.01, 1.11, 1.19, 84/1.22, 1.24, 1.25, DIG. 9, 1.23; 332/31 R, 31 T, 38, 40; 179/1 D, 1 M

[56] References Cited

U.S. PATENT DOCUMENTS

| | | | |
|---|---|---|---|
| 3,004,460 | 10/1961 | Wayne | 84/1.22 |
| 3,943,456 | 3/1976 | Luce | 84/1.01 |
| 3,974,461 | 8/1976 | Luce | 84/1.19 |
| 4,064,778 | 12/1977 | Uchiyama | 84/1.25 |
| 4,114,498 | 9/1978 | Chibana | 84/1.19 |

*Primary Examiner*—Gene Z. Rubinson
*Assistant Examiner*—William L. Feeney
*Attorney, Agent, or Firm*—Christie, Parker & Hale

[57] ABSTRACT

A tone synthesizer in which a musical tone of selected fundamental frequency is generated with a resonance effect at selected harmonics of the tone. The resonance effect is produced by adding an amplitude modulated carrier signal to the musical tone, the carrier signal being modulated by a signal having the fundamental frequency of the musical tone and the carrier frequency being an integral multiple of the fundamental.

18 Claims, 11 Drawing Figures

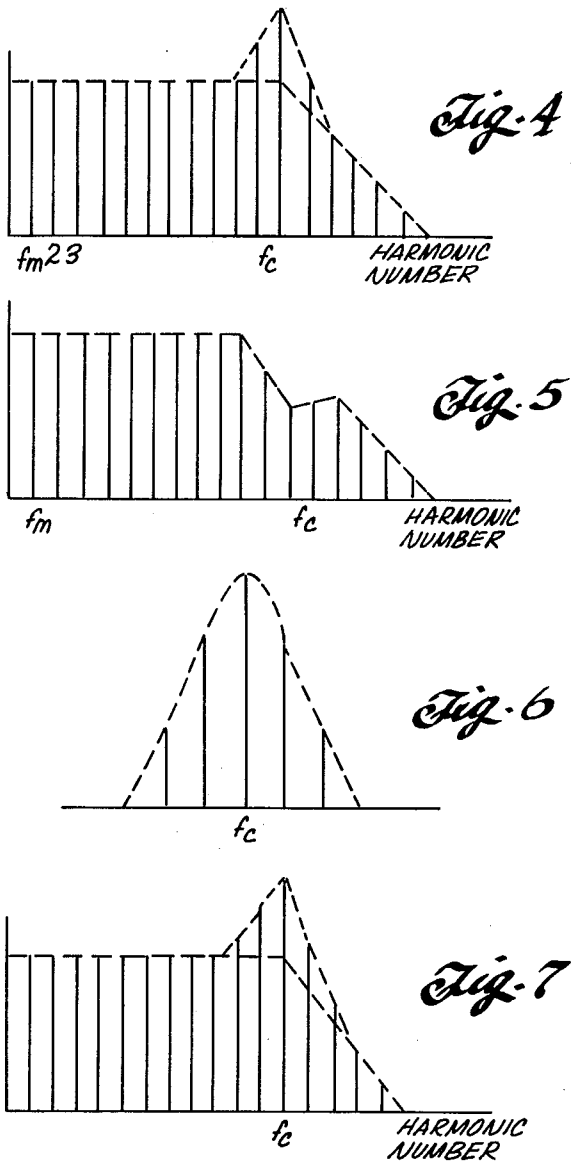
Fig. 4
HARMONIC NUMBER
fc
fm23
Fig. 5
HARMONIC NUMBER
fc
fm
Fig. 6
fc
Fig. 7
HARMONIC NUMBER
fc
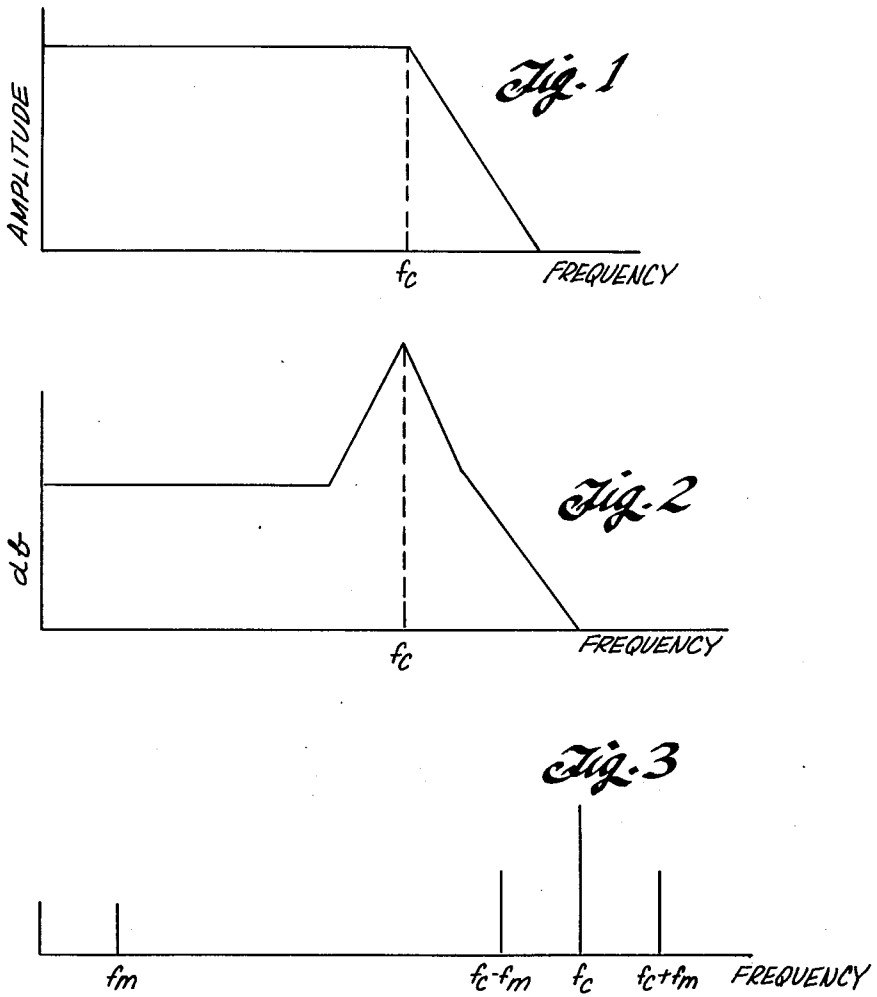
Fig. 1
FREQUENCY
fc
AMPLITUDE
Fig. 2
FREQUENCY
fc
db
Fig. 3
FREQUENCY
fc+fm
fc
fc-fm
fm

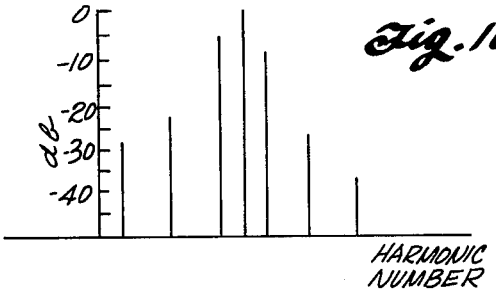
Fig. 10
Fig. 11
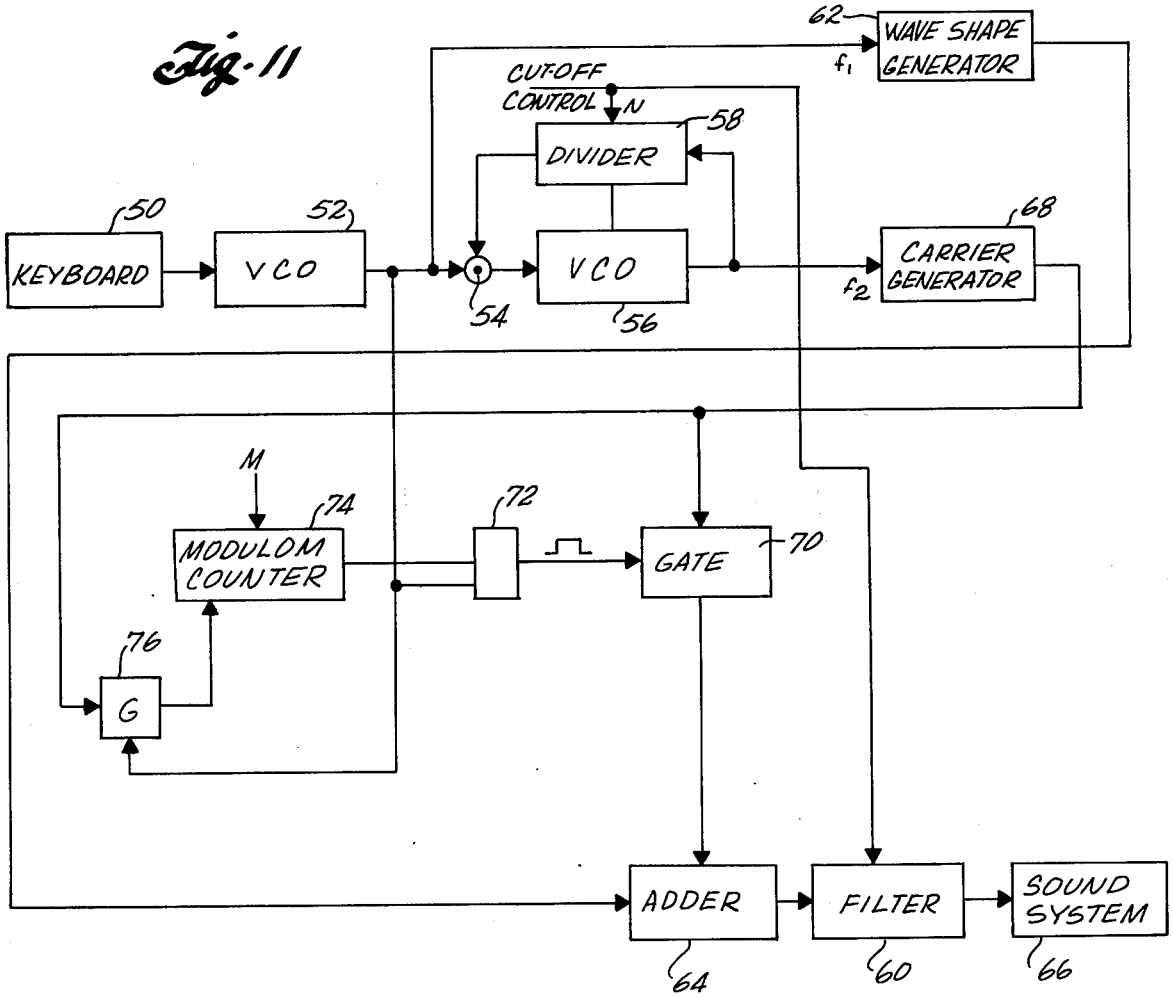

RESONATOR FOR A MUSICAL TONE SYNTHESIZER

FIELD OF THE INVENTION

This invention relates to musical tone synthesizers and, more particularly, with a tone generator producing a resonance effect.

BACKGROUND OF THE INVENTION

Electronic musical instruments of the synthesizer type use a variety of spectral transformations to produce special effects. One effect is that of the resonator. For example, a tone synthesizer may employ a low-pass or high-pass filter in which the cutoff frequency is made to vary as a function of time. The resonator effect is usually produced by a tuned resonant circuit that follows or precedes the low-pass filter, the resonator operating to enhance harmonic overtones near the cutoff frequency of the filter. The tonal effect of the resonator is referred to as the Q-accent effect.

The Q-accent effect has been implemented in digital tone generators of the type in which the musical wave shapes are synthesized by a Fourier calculation using stored harmonic coefficients. For example, in U.S. Pat. No. 3,956,960, entitled "Formant Filtering in a Computer Organ", there is disclosed means for eliminating, attenuating or accentuating certain Fourier components included in each wave shape amplitude computation. A set of formant filter factors define the formant filter pass band as a function of frequency, logarithmic frequency, or Fourier component order. As each Fourier component is independently evaluated, the amplitude is scaled by the appropriate formant filter factor. The resulting amplitude values produce a synthesized musical tone which includes only Fourier components within the defined pass band, so that formant filtering effectively is implemented without the use of an actual filter. An alternative arrangement is disclosed in U.S. Pat. No. 4,000,675, entitled "Electronic Musical Instrument", in which the harmonic attenuation is accomplished by a calculation algorithm, rather than a stored set of scale factors. Neither of these arrangements, however, is suitable for generating a Q-accent effect in an analog synthesizer or in a digital organ of the type described in U.S. Pat. No. 3,515,792, for example, where the harmonic components are not separately calculated or stored.

SUMMARY OF THE INVENTION

The present invention provides an arrangement for producing a Q-accent effect in known analog and digital musical tone generators. According to the present invention, the desired Q-accent tonal effect is obtained by adding two wave shapes together. One of the wave shapes is that for the unaccentuated tone, and the other wave shape provides enhanced upper and lower harmonics. The accentuated tone effect is generated by adding an amplitude modulated sinusoid signal to the unaccentuated tonal signal, the amplitude modulated sinusoid signal having a carrier frequency corresponding to one of the higher or lower harmonics of the unaccentuated tone, the carrier being amplitude modulated at the fundamental frequency of the tone being generated. An alternative arrangement is to use a gated or pulse modulated sinusoid in which the pulse repetition frequency corresponds to an upper harmonic of the wave form being accentuated, with the pulse width being variable.

DESCRIPTION OF THE DRAWINGS

For a better understanding of the invention, reference should be made to the accompanying drawings wherein:

FIGS. 1–7 are a series of wave forms useful in explaining the operation of the present invention;

FIG. 10 is a wave form useful in explaining an alternative embodiment; and

FIG. 11 is a block diagram of the alternative embodiment of FIG. 10.

DETAILED DESCRIPTION

Figure 8:
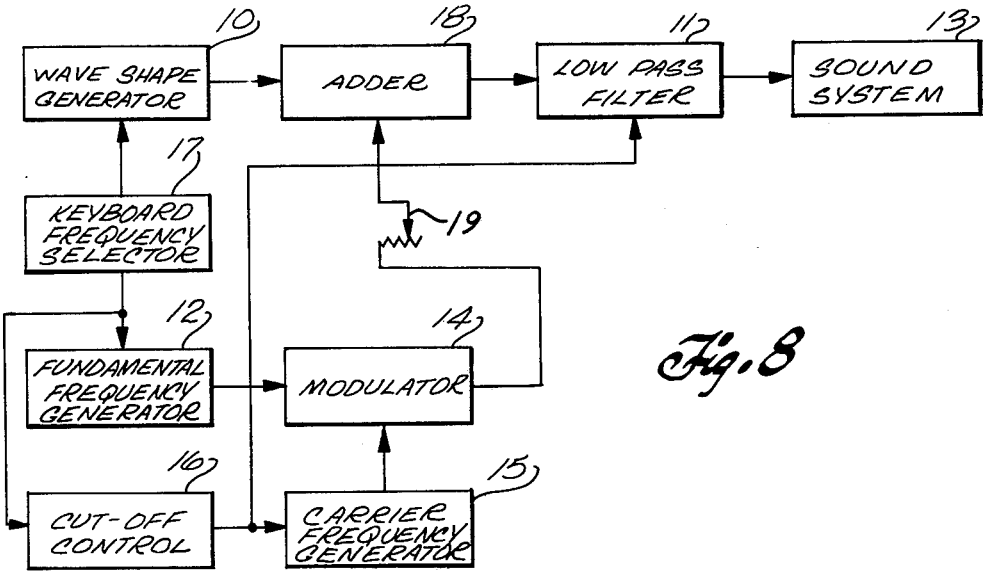
FIG. 8 is a block diagram of an analog embodiment of the invention.

Referring to FIG. 1, there is shown the frequency characteristic of a low-pass filter in a musical tone synthesizer. Cutoff $f_c$ is made to vary as a function of time, thereby changing the quality of the tone as a function of time. When combined with a resonator tuned to resonate at the cutoff frequency, the resulting amplitude spectral characteristic as a function of frequency is that of FIG. 2. The resulting Q-accent effect enhances the amplitude of the harmonics near the cutoff frequency $f_c$. It is desirable that the relationship of $f_c$ to the fundamental frequency $f_m$ of the tone being generated be the same from note to note. Thus, $f_c$ not only changes as a function of time, but changes as a function of the fundamental frequency of the tone being generated. To provide conventional filters to produce this effect has presented problems.

The present invention is directed to an arrangement for producing the Q-effect, which can be combined with a formant filter so that the resonant frequency will track the cutoff frequency of the formant filter and will track the change in the fundamental frequency. In one form of the invention, this is accomplished by combining an amplitude modulated signal with the signal of the unaccentuated tone. An amplitude modulated sinusoid signal can be expressed mathematically as:

$$x(t)=A[1+m \sin (2\pi f_m t)] \sin 2\pi \text{ ft}. \quad (1)$$

This can be written in equivalent form as:

$$x(t)=A \sin 2\pi \text{ ft} + \text{Am}/2 \cos [2\pi(f+f_m)t] - \text{Am}/2 \cos [2\pi(f-f_m)t] \quad (2)$$

The frequency spectrum of equation 2 is shown in FIG. 3, in which the carrier frequency is equal to $f_c$, and the modulation frequency is equal to the fundamental frequency $f_m$ of the tone. If this amplitude modulated signal is then added to the filtered tone, the resulting spectrum is that shown in FIG. 4, in which $f_c$ is substantially equal to the twelfth harmonic of the fundamental pitch of $f_m$. The eleventh and thirteenth harmonics are also enhanced, but to a lesser degree, by the sidebands of the frequency modulated signal. It will be noted the spectrum of FIG. 4 is similar in shape to the desired Q-accent wave form of FIG. 2. If the amplitude modulated signal is subtracted, rather than added to, the unaccentuated signal, the resulting spectrum would take on the shape shown in FIG. 5. Additional sidebands may be added by modulating the carrier with both the first and second harmonics of the tone being generated, as shown by the following equation:

$$y(t)=A[1+m_1 \sin (2\pi f_{m1}t)+m_2 \sin (2\pi f_{m2})] \sin 2\pi ft. \quad (3)$$

FIG. 6 shows the spectral components produced by equation 3, and FIG. 7 illustates the resulting adding of the spectral shape of FIG. 6 to that of the unaccentuated tone passed through a low-pass filter in which the cutoff frequency corresponds to the carrier frequency of the amplitude modulated component.

Referring to FIG. 8, there is shown a block diagram of an analog circuit for implementing the Q-accent. In FIG. 8, the numeral 10 indicates generally a wave shape generator, which generates a musical or audio tone signal having the basic wave shape. The wave shape of the generator 10 is usually not a sine wave, but is a wave rich in harmonic overtones. The fundamental frequency of the output of the wave shape generator 10 is usually controlled by a keyboard, as in a conventional monophonic tone synthesizer. The output of the wave shape generator 10 is applied through a voltage-controlled low-pass filter (VCF) 11 to the sound system 13. As in a conventional synthsizer, the low-pass filter is voltage-controlled to shift the cutoff frequency of the filter, both with changes in the frequency of the fundamental and as a function of time. A keyboard or other frequency selector for the wave shape generator 10 is indicated at 17.

The frequency selector 17 also is connected to a cutoff control circuit 16, which controls the low-pass filter 11, such that when the fundamental frequency of the generator 10 is shifted from note to note, the low-pass filter 11 cutoff frequency is shifted accordingly so that the cutoff frequency always corresponds to the same overtone of the fundamental frequency of the tone being generated. The cutoff control 16 may also vary the cutoff frequency as a function of time while a particular key on the keyboard is held down. As thus far described, the analog circuit of FIG. 8 corresponds to the conventional tone synthesizer.

The keyboard frequency selector 17 also controls a fundamental frequency generator 12 for generating a sine wave signal having a frequency corresponding to the fundamental frequency of the tone generator 10. The output of the fundamental frequency generator 12 is used to amplitude modulate a carrier signal from a carrier frequency generator 15 by means of an amplitude modulator circuit 14. The frequency of the carrier frequency generator 15 is adjustable and is controlled by the output of the cutoff control circuit 16, so that the carrier frequency $f_c$ tracks the cutoff frequency of the low-pass filter 11. Thus, the output of the modulator 14 corresponds to the spectrum shape shown in FIG. 3. The output of the modulator is added to the output of the wave shape generator 10 by an adder circuit 18, the combined wave shapes being applied to the input of the audio sound system indicated at 13. Thus, the output of the adder corresponds to the spectrum shape shown in FIG. 4 with the harmonics at the cutoff frequency being enhanced to produce the desired Q-accent effect.

As in conventional synthesizers, a high-pass filter may be used in place of the low-pass filter 11 so as to pass only the higher harmonics of a tone. The Q-effect circuit of the present invention, at the cut-off frequency of the high-pass filter, is otherwise identical to that described.

Figure 9:
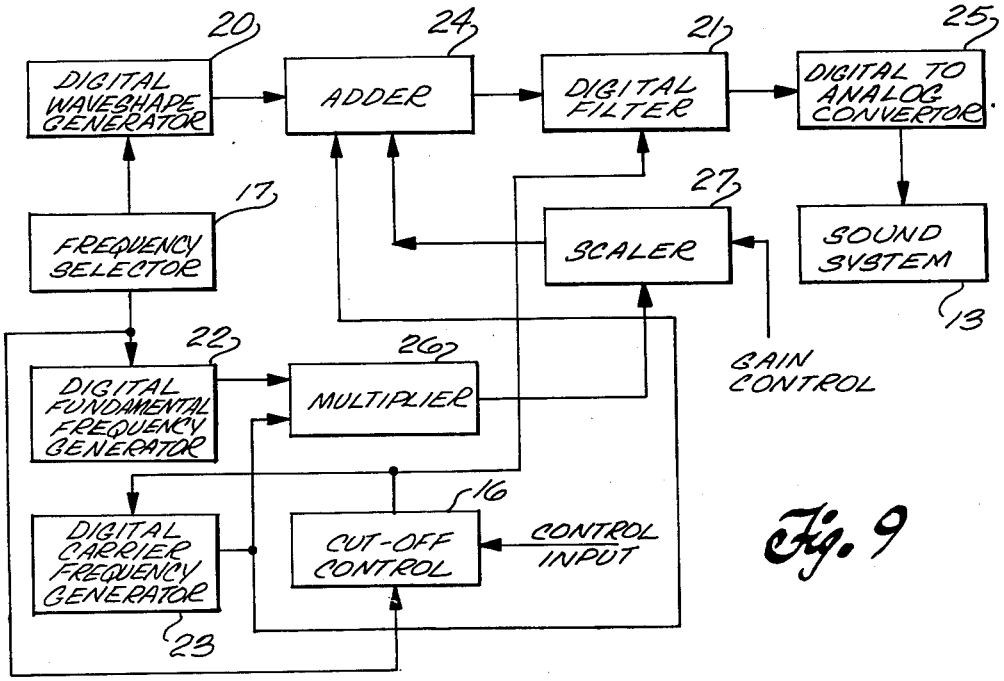
FIG. 9 is a block diagram of a digital embodiment of the invention.

FIG. 9 shows a circuit for implementing the Q-accent generator in a digital tone generator. A keyboard or frequency selector 17 controls a digital wave shape generator 20, such as the wave shape generator of the digital organ described in U.S. Pat. No. 3,515,792. The output from the digital wave shape generator is a series of digital words defining the amplitudes of sample points on the desired wave shape. The data from the wave shape generator may be applied through an adder 24 and a digital filter 21 to a digital-to-analog converter 25, which converts the data to an analog signal for driving the sound system 13. As in the arrangement of FIG. 8, the digital filter is controlled by a cutoff control 16 for changing the effective cutoff frequency of the filter as a function of time and also as a function of the fundamental frequency of the notes selected by the frequency selector 17. A digital carrier frequency generator 23 produces a series of sinusoid values corresponding to sample points on a sine wave at the carrier frequency. Generator 23, like digital wave shape generator 20, may be a shift register containing a set of digitized data points defining the amplitudes of a series of sample points along one cycle of the wave form. The frequency selector 17, in response to operation of a particular key, for example, causes one cycle of data to be shifted out of the digital wave shape generator 20 and the digital fundamental frequency register 22 at the fundamental frequency of the note being played. The output of the frequency selector 17, by means of the cutoff control 16, causes the digital carrier frequency generator 23 to be shifted at a higher rate, preferably at an integral multiple of the fundamental frequency, so as to correspond to a predetermined harmonic of the fundamental frequency. The output of the cutoff control 16 also sets the cutoff frequency of a digital low-pass filter 21 so that the cutoff frequency of the filter tracks the carrier frequency. The cutoff contrl 16 may be preset to provide any desired band spread between the fundamental frequency of the tone being generated and the cutoff frequency of the filter.

Amplitude modulation of the carrier frequency by the fundamental frequency is provided by a multiplier 26, which multiplies the output of the carrier frequency generator 23 and the fundamental frequency generator 22 with each shift of the carrier frequency generator 23. The output of the multiplier 26 is applied to one input of the adder 24, together with the output of the digital wave shape generator 20, to achieve the desired composite wave form.

The Q-accent may include a gain control on the input of the adder, which, in the analog version of FIG. 8, may be a simple potentiometer 19, and in the digital version may be a scaler 27 in which the scale factor is controlled by an input gain control signal.

Equation 3, discussed above, indicate that multiple sidebands can be achieved by modulating with more than one modulation signal, such as the first and second harmonics of the tone being generated. A more generalized expression of equation 3 can be written as follows:

$$y(t) = A[1 + \sum_n m_n \sin(2\pi fnt] \sin 2\pi f_c t \quad (4)$$

$$= a[1 + g(f,t)] \sin 2\pi f_c t$$

It will be seen that from equation 4 the function g is a function involving the sum of a number of multiples of the fundamental frequency. An important special case for the value of g(f,t) is a rectangular wave having a pulse repetition frequency corresponding to the fundamental frequency of the tone being generated and having a pulse width determined by $1/f_c$, that is, having a time duration corresponding to the period of one cycle at the carrier frequency. FIG. 10 illustrates the spectral plot of y(t) for $f_c$ equal to eight times the fundamental frequency, and the pulse width corresponding to four periods of $f_c$.

A circuit for implementing equation (4) is shown in FIG. 11 in which a keyboard 50 controls a voltage-controlled oscillator 52 for generating an output signal at the fundamental frequency fm of the tone selected on the keyboard. The output of voltage-controlled oscillator 52 is applied to a phase loop control circuit for generating a second output frequency $f_c$, which is a predetermined multiple of the ouput of the frequency of the voltage-controlled oscillator 52. The phase loop control circuit includes a phase detector 54, the output of which controls a voltage-controlled oscillator 56. The output signal from the oscillator 56 is applied to a divider circuit 58, the output of which is applied to the phase detector 54. A fixed ratio is maintained beween the frequency of the output of the oscillator 52 and the output of the oscillator 56 by the divider 58. The ratio of the divider 58 can be controlled by a cutoff control signal, which also controls the cutoff frequency of the low-pass filter 60.

The fundamental frequency of the tone derived from the oscillator 52 is used to control the frequency of a wave shape generator 62. The output of the wave shape generator is applied as one input to an adder circuit 64, the output of which is applied through a low-pass filter 60 to the sound system 66.

The output of the oscillator 56 is used to control the frequency of a carrier generator 68. The output wave form of the carrier generator 68 is preferably a sine wave having a frequency that is an integral multiple of the fundamental frequency of the signal from the wave shape generator 62. Thus, the output of the carrier generator corresponds to any selected one of the higher harmonics of the fundamental of the tone being generated. The particular harmonic is determined by the cutoff control signal as applied to the divider 58 in the manner described above. The output of the carrier generator is applied through a gate 70 to the other input of the adder 64. The gate 70 is controlled by a latch 72, which is turned on once each cycle of the fundamental as determined by the output of the oscillator 52. The latch is reset to turn off the gate 70 by the output of a modulo M counter 74, which is counted by pulses at the carrier frequency of the carrier generator 68 applied to the counter through a gate 76, also controlled by the latch 72. Thus, the gate 70 will remain open for M number of pulses at the carrier frequency. In practice, if the carrier or cutoff frequency is selected to be equal to or greater than the sixth harmonic of the fundamental, M is made equal to 5; that is, the gate 70 will remain open for five periods at the carrier frequency. If the carrier frequency is set to a lower harmonic of the fundamental, M is set to be 1 less than the harmonic number. Thus, if the carrier frequency is the fourth harmonic of the fundamental, M is set to 3.

The arrangement of FIG. 11 can be implemented either as an analog circuit or as a digital circuit; that is, the wave shape generator may generate either an analog signal or a series of digitized samples of the amplitude of the wave form being generated. If the output of the wave shape generator and carrier generator are in the form of digital data, the adder 64 is a digital adder, and the output of the adder is applied to a digital-to-analog converter. If the filter 60 is before the converter, then the filter 60 must be a digital filter. If positioned after the converter, the filter 60 may be an analog-type, voltage-controlled filter. It will be seen that the output of the gate 70 is a pulse-modulated carrier having the spectral shape shown in FIG. 10, for example. This spectral shape, when added to the spectral shape of the output of the wave shape generator 62 provides the desired Q-accent at the cutoff frequency of the low-pass filter.

What is claimed is:

1. A tone synthesizer having a resonance characteristic comprising means generating an audio tone signal having a plurality of harmonics, means generating a sinusoid signal having a frequency higher than the fundamental of the audio tone, means including a modulation signal source generating a signal having the frequency of the fundamental of the audio tone signal, means amplitude modulating the sinusoid signal, and means adding the amplitude modulated sinusoid signal to the audio tone signal.

2. Apparatus of claim 1 wherein the sinusoid signal has a frequency corresponding to a harmonic of the audio tone.

3. Apparatus of claim 1 further including a filter for filtering the audio tone signal having a cutoff frequency corresponding to the frequency of the sinusoid signal.

4. Apparatus of claim 1 further including means for changing the frequency of the sinusoid with changes in the fundamental of the audio tone signal.

5. Apparatus of claim 1 further including means for maintaining the ratio of the fundamental frequency and the frequency of the sinusoid signal constant with changes in the fundamental frequency of the audio tone signal.

6. Apparatus of claim 3 further including means for maintaining the ratio of the fundamental frequency and the frequency of the sinusoid signal constant with changes in the fundamental frequency of the audio tone signal.

7. Apparatus of claim 6 wherein the filter is a low-pass filter including means changing the cutoff frequency with changes in the frequency of the sinusoid.

8. Apparatus of claim 6 wherein the filter is a high-pass filter including means changing the cutoff frequency with changes in the frequency of the sinusoid.

9. Apparatus of claim 1 wherein the modulation signal source generates a rectangular wave in which the pulse repetition frequency is equal to the fundamental frequency of the audio tone signal.

10. Apparatus of claim 5 wherein the modulation signal source generates a rectangular wave in which the pulse repetition frequency is equal to the fundamental frequency of th audio tone signal.

11. Apparatus of claim 10 wherein the pulse width of the rectangular wave is an integral multiple of the period of the sinusoid signal.

12. A Q-accent circuit for a synthesizer in which a tone is generated at a selected fundamental frequency, comprising means synchronized with the fundamental frequency of the generated tone for generating a sinusoid signal having a frequency higher than the fundamental by a predetermined ratio, means for amplitude modulating the sinusoid signal by a periodic signal having the selected fundamental frequency of the generated tone, and means adding the amplitude modulated sinusoid signal to the generated tone.

13. Apparatus of claim 12 wherein the periodic signal is a sine wave.

14. Apparatus of claim 12 wherein the periodic signal is a rectangular wave.

15. Apparatus of claim 12 wherein said predetermined ratio is variable.

16. Apparatus of claim 12 wherein said predetermined ratio is an integral ratio, whereby the periodic signal frequency is a true harmonic of the fundamental frequency of the generated tone.

17. Apparatus of claim 12 further including a filter having a cutoff frequency equal to the frequency of the periodic signal.

18. Apparatus of claim 14 wherein the pulse width of the rectangular wave is equal to an integral number of cycles of the period wave.

* * * * *